US006973948B2

(12) United States Patent
Pollack et al.

(10) Patent No.: US 6,973,948 B2
(45) Date of Patent: Dec. 13, 2005

(54) GAS OFFLOADING SYSTEM

(75) Inventors: Jack Pollack, Houston, TX (US); Hein Wille, Eze (FR)

(73) Assignee: SBM-Imodco, Inc., Houston, TX (US)

( * ) Notice: Subject to any disclaimer, the term of this patent is extended or adjusted under 35 U.S.C. 154(b) by 0 days.

(21) Appl. No.: 10/923,577

(22) Filed: Aug. 20, 2004

(65) Prior Publication Data

US 2005/0061395 A1 Mar. 24, 2005

Related U.S. Application Data

(60) Provisional application No. 60/515,767, filed on Oct. 30, 2003, provisional application No. 60/504,449, filed on Sep. 19, 2003.

(51) Int. Cl.[7] ..... B65B 1/04

(52) U.S. Cl. ..... 141/387; 141/284; 141/82; 441/3

(58) Field of Search ..... 141/387, 284, 141/82, 98; 441/3–5; 62/50.1, 50.2, 53.1; 405/59

(56) References Cited

U.S. PATENT DOCUMENTS 4,270,611 A * 6/1981 Arnaudeau et al. ..... 166/344
4,299,260 A * 11/1981 Jansen ..... 141/311 R
4,301,840 A * 11/1981 Jansen ..... 141/98
5,129,759 A 7/1992 Bishop
6,298,671 B1 10/2001 Kennelley et al.
2002/0134455 A1 9/2002 Emblem et al.
2003/0051875 A1 3/2003 Wilson

* cited by examiner

*Primary Examiner*—Steven O. Douglas
(74) *Attorney, Agent, or Firm*—Leon D. Rosen

(57) ABSTRACT

A system is described for offloading LNG (liquified natural gas) from a tanker for eventual delivery to an onshore gas distribution station. The system includes a floating structure that floats at the sea surface and that is connected to the tanker so they weathervane together. The floating structure carries a regas unit that heats the LNG to produce gas, and delivers the gas through a riser to an underground cavern that stores the gas. Gas from the cavern is delivered through a seafloor pipeline to an onshore gas distribution station. The regas unit includes water pumps and other equipment that is powered by electricity. The electricity can be obtained from an electric generator on the floating structure, with surplus electricity delivered through a sea floor electric power line that extends along the sea floor to an onshore electricity distribution facility. The electricity can instead be obtained by delivery from an onshore facility though a sea floor electric power line that extends up to the floating structure and to the regas unit.

19 Claims, 7 Drawing Sheets

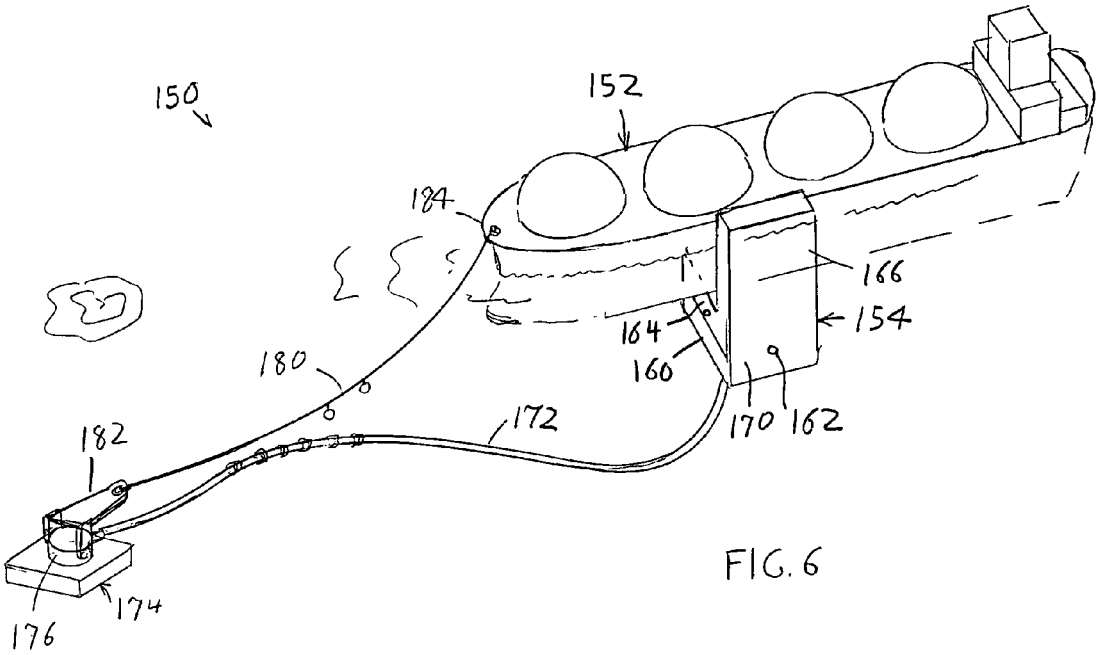
FIG. 6
FIG. 7
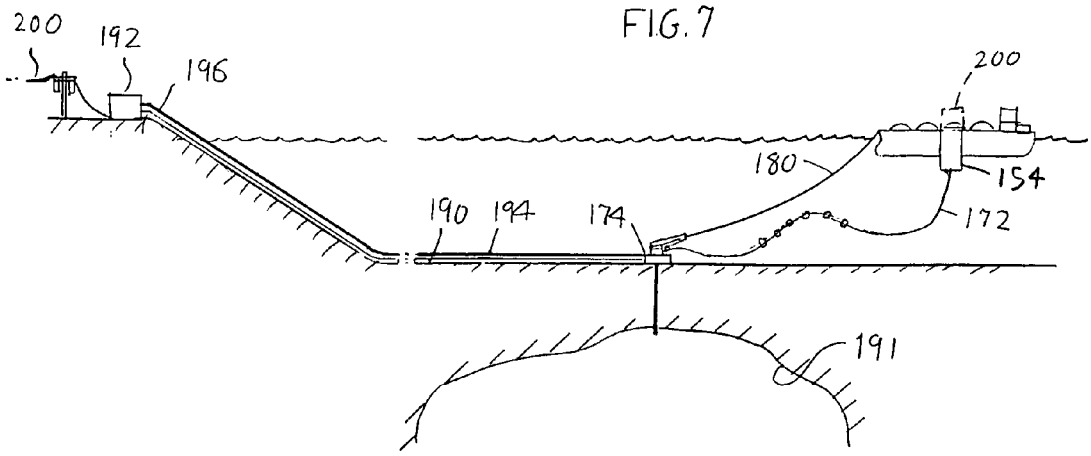

GAS OFFLOADING SYSTEM

CROSS REFERENCE

Applicant claims priority from U.S. Provisional application Ser. No. 60/504,449 filed 19 Sep. 2003 and Ser. No. 60/515,767 filed 30 Oct. 2003.

BACKGROUND OF THE INVENTION

Hydrocarbons that are in a gaseous state at atmospheric pressure and room temperature (e.g. 20° C.), are often transported as cold hydrocarbons, as by ship in liquid form such as LNG (liquified natural gas), at atmospheric pressure and −160° C. Another form of cold gaseous hydrocarbons that are ship-transported are hydrates (gas entrapped in ice). At the ship's destination, the LNG (or other gas) may be heated and flowed to an onshore distribution facility. Proposed prior art offloading stations have included a fixed platform extending up from the sea floor to a height above the sea surface and with a regas unit on the platform for heating the LNG. Because of fire dangers in dealing with LNG, rigid platforms, which minimize flexing joints, have previously been proposed for offloading LNG from a tanker and heating it to gassify it.

The cost of a fixed platform is high even at moderate depths, and at increasing depths (e.g. over 50 meters) the costs of fixed platforms increase dramatically. In addition, if the platform lies in an open sea it is difficult to moor a tanker to the platform because the tanker shifts position and heading with changing winds, waves and currents. An offshore LNG offloading and regas station which avoided the use of fixed platforms, and which provided the high reliability demanded in LNG offloading, heating and storage, would lower the cost of such stations and allow them to be used in situations where they previously were uneconomical.

SUMMARY OF THE INVENTION

In accordance with one embodiment of the present invention, a relatively low-cost system is provided for offloading cold hydrocarbons, and especially LNG (liquified natural gas), and transporting the gas to an onshore gas distribution station. The system includes a floating structure such as a barge at the sea surface that is moored so it weathervanes. A tanker carrying LNG attaches itself to the floating structure so they weathervane together. A regas unit which heats the LNG, usually by transferring heat from sea water, transforms the LNG into gas that can be more easily passed through moderate cost hoses or pipes and eventually to the onshore distribution station.

A new tanker arrives at the floating structure perhaps every week, and efforts are made to offload the tanker as fast as possible, perhaps in one day. To provide a steady flow of gas to the onshore distribution station, much of the rapidly-offloaded and regased LNG is stored in an underground (and usually undersea) cavern. The gas is slowly flowed from the cavern along a seafloor pipeline to the onshore distribution station, to provide a steady gas supply without requiring a large gas storage facility at the onshore station.

The regas unit and pumps for pressurizing gas, are preferably electrically energized for safety and convenience. Electric power on the order of 60 megawatts may be required. Such electrical energy can be obtained from a power generator apparatus on the floating structure that uses gas from the tanker for fuel. The regas unit may require electric power only part of the time, such as one day per week when LNG is being offloaded and regassed. The rest of the time (e.g. several days per week) electric power from the power generator apparatus is passed through a seafloor electric power line to an onshore electric distribution facility. The generation of electric power at the floating structure is economical because the gas fuel is already available and because a large amount of expensive land is not required to isolate the power generation apparatus from onshore homes and businesses for safety.

Electric power instead can be obtained from an onshore electric power distribution facility. In that case, an electric power line extends from the onshore facility and along the sea floor and up to the floating structure.

The novel features of the invention are set forth with particularity in the appended claims. The invention will be best understood from the following description when read in conjunction with the accompanying drawings.

BRIEF DESCRIPTION OF THE DRAWINGS

FIG. 6 is a top isometric view of an offshore gas offloading and transfer system of another embodiment of the invention.

FIG. 7 is a sectional side view of the system of FIG. 6.

DESCRIPTION OF THE PREFERRED EMBODIMENTS

Figure 1:
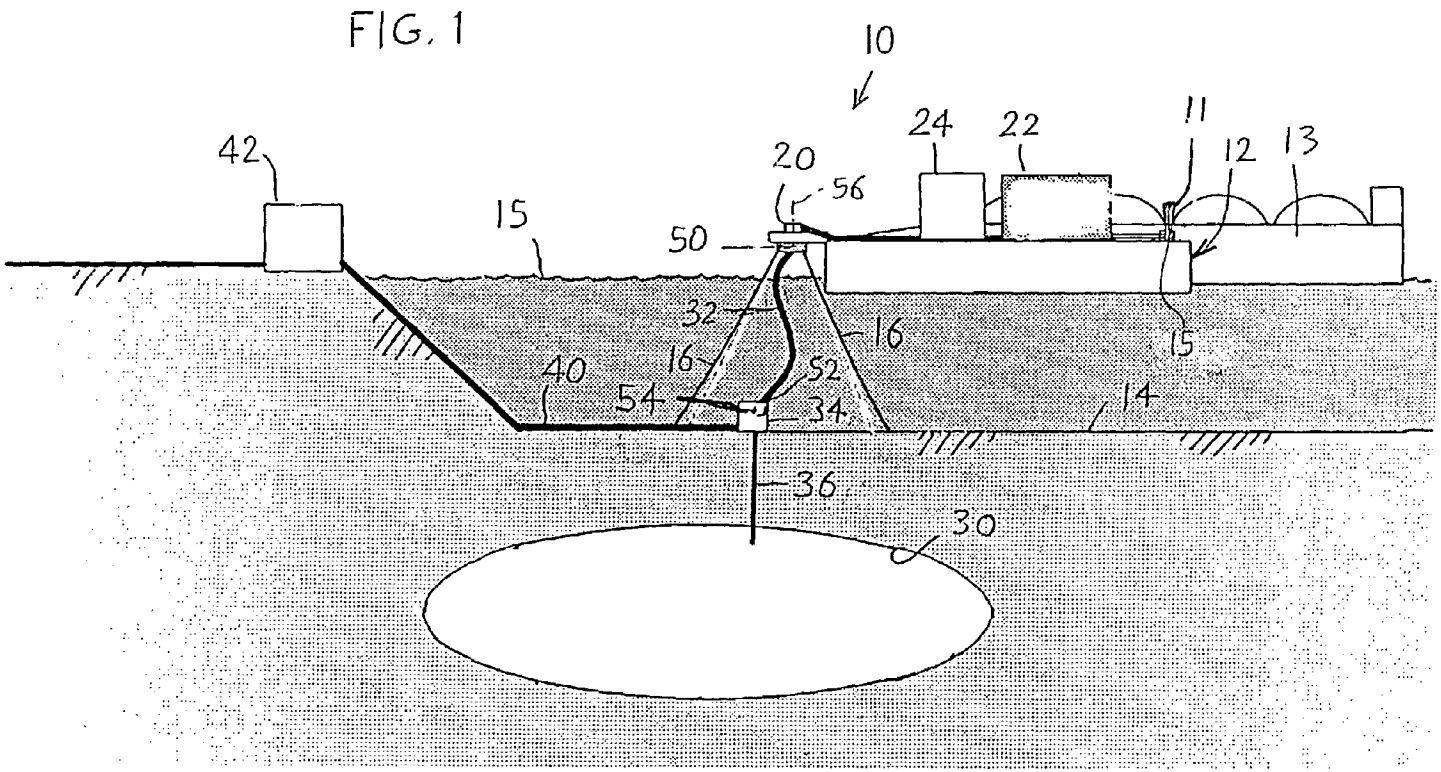
FIG. 1 is a partially sectional side view of an offshore gas offloading and transfer system of a first embodiment of the invention.

FIG. 1 illustrates an offloading and transfer station 10 that includes a weathervaning floating structure in the form of a single barge 12 (there could be more than one barge) that floats at the sea surface 15. The barge receives LNG through a coupling 15 and a loading arm 11 extending from midship of a tanker 13. The barge is moored to the seafloor 14 by chains 16 extending from a turret 20 mounted at the bow of the barge. The illustrated chains extend in catenary curves to the seafloor and along the seafloor to anchors. Preferably, the tanker is moored to the barge and they weathervane together. This allows the barge and tanker to move in unison and therefore remain close together in an open sea. A regas unit 22 (for heating LNG to produce gas) and an injection unit 24 for pumping the LNG or gas to a high pressure, are both located on the barge, and are used for injection of gas into an underground cavern 30 that lies under the sea. The regas unit usually transfers heat from seawater to the LNG to change it into gas. A flexible riser 32 (there often can be two or more) extends up from a platform 34 on the seafloor to the barge. The platform is connected through a pipe 36 to the cavern 30 in which the pressured gas is stored, that results from heating LNG. A pipeline 40 extends primarily along the sea floor to an onshore gas distribution station 42. The onshore station can be a gas grid that distributes the gas to users, can be a power plant that distributes the gas to gas turbines, etc.

The flexible riser 32 and connections 50, 52 at its opposite ends, can be made highly reliable. In addition, reliable shutoff valves are present at 54 on the platform and on the barge. During the past forty years or so, large numbers of flexible risers have been designed, constructed and used in offshore installations to produce hydrocarbons (usually including gas and liquid) from undersea reservoirs. Experience gained from such use has resulted in high reliability. By using such reliable flexible risers and shutoff valves in the present floating offloading and injection station, applicant is able to achieve the same high standards of reliability previously achieved with fixed platforms, but at far lower cost.

Figure 1A:
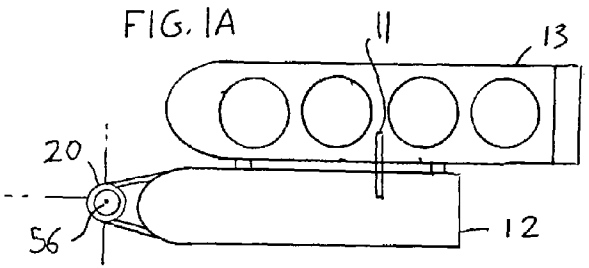
FIG. 1A is a plan view of a portion of the system of FIG. 1.
Figure 1B:
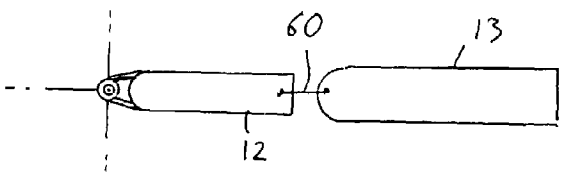
FIG. 1B is a plan view of a portion of a system that is a variation of FIG. 1A.

FIG. 1A shows the tanker 13 and barge 12 held together to weathervane together about the turret axis 56. FIG. 1B shows the tanker moored to the barge by a hawser 60, so they weathervane together.

Figure 2:
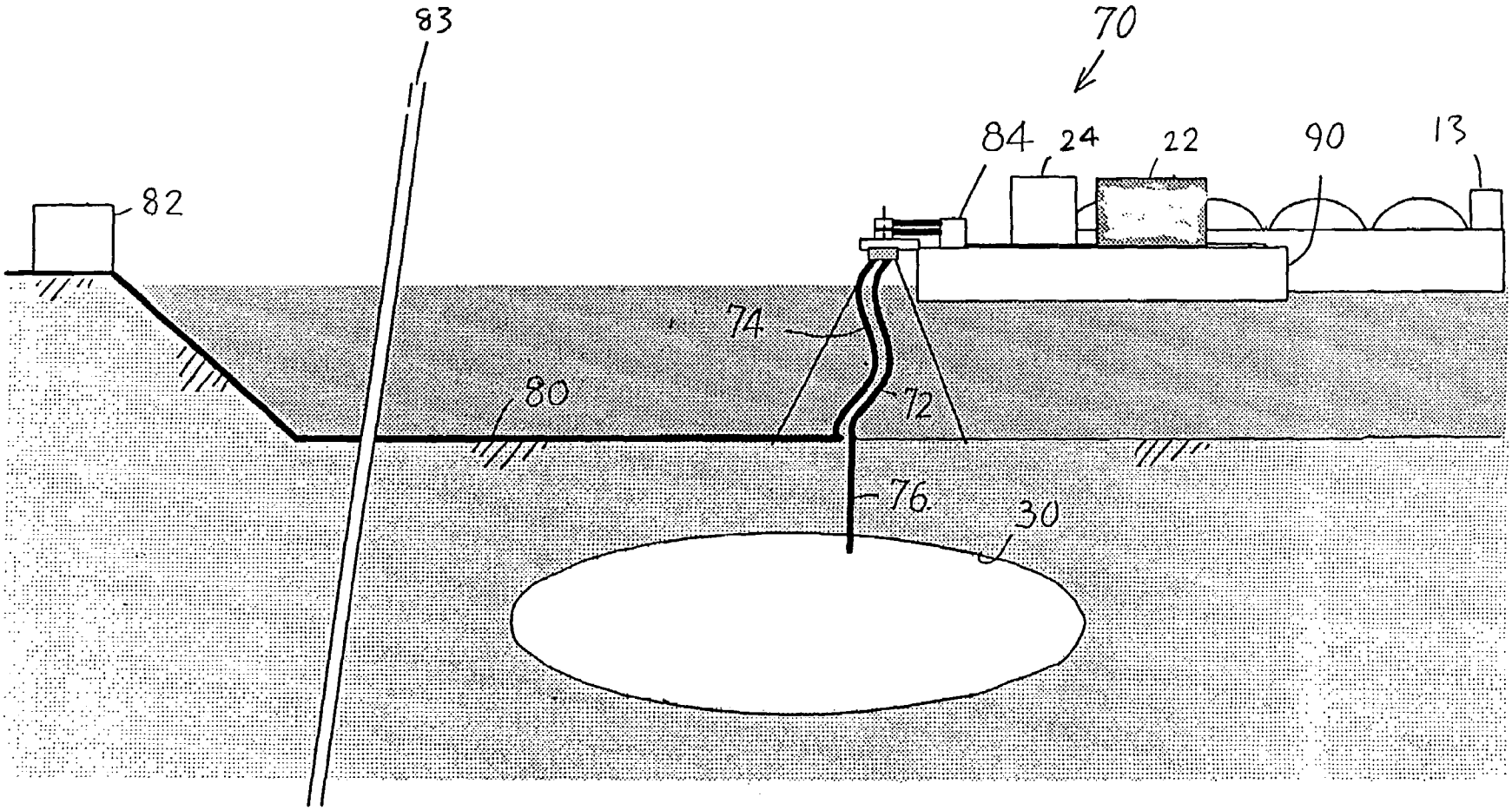
FIG. 2 is a partially sectional side view of an offshore gas offloading and transfer system of another embodiment of the invention.

FIG. 2 shows an offloading/injection station 70 similar to that of FIG. 1, except that two risers 72, 74 are shown. One riser 72 connects to a pipe 76 that extends to the cavern 30. The other riser 74 connects directly to a sea floor pipeline 80 that extends to the onshore station 82. A break is indicated at 83 to indicate that the pipeline may be long (e.g. over one kilometer). A pressure boosting unit 84 on the barge 90 can pressurize gas that is pumped through the pipeline 80. Such pressured gas is directed through valves in the onshore station 82 but the gas does not have to be pressurized by the onshore station. This keeps the pumps at 84 far from any inhabited structures on shore.

During regasification of LNG on a vessel and offloading of gas from the vessel, some of the offloaded gas is injected via riser 72 into the cavern 30 while other gas is transferred through riser 74 to the shore station. When no LNG is being offloaded, gas is removed from the cavern via the riser 72, its pressure is boosted by pressure boosting unit 84, and sent to the shore station via riser 74. Thus, riser 72 is used bi-directionally.

Figure 3:
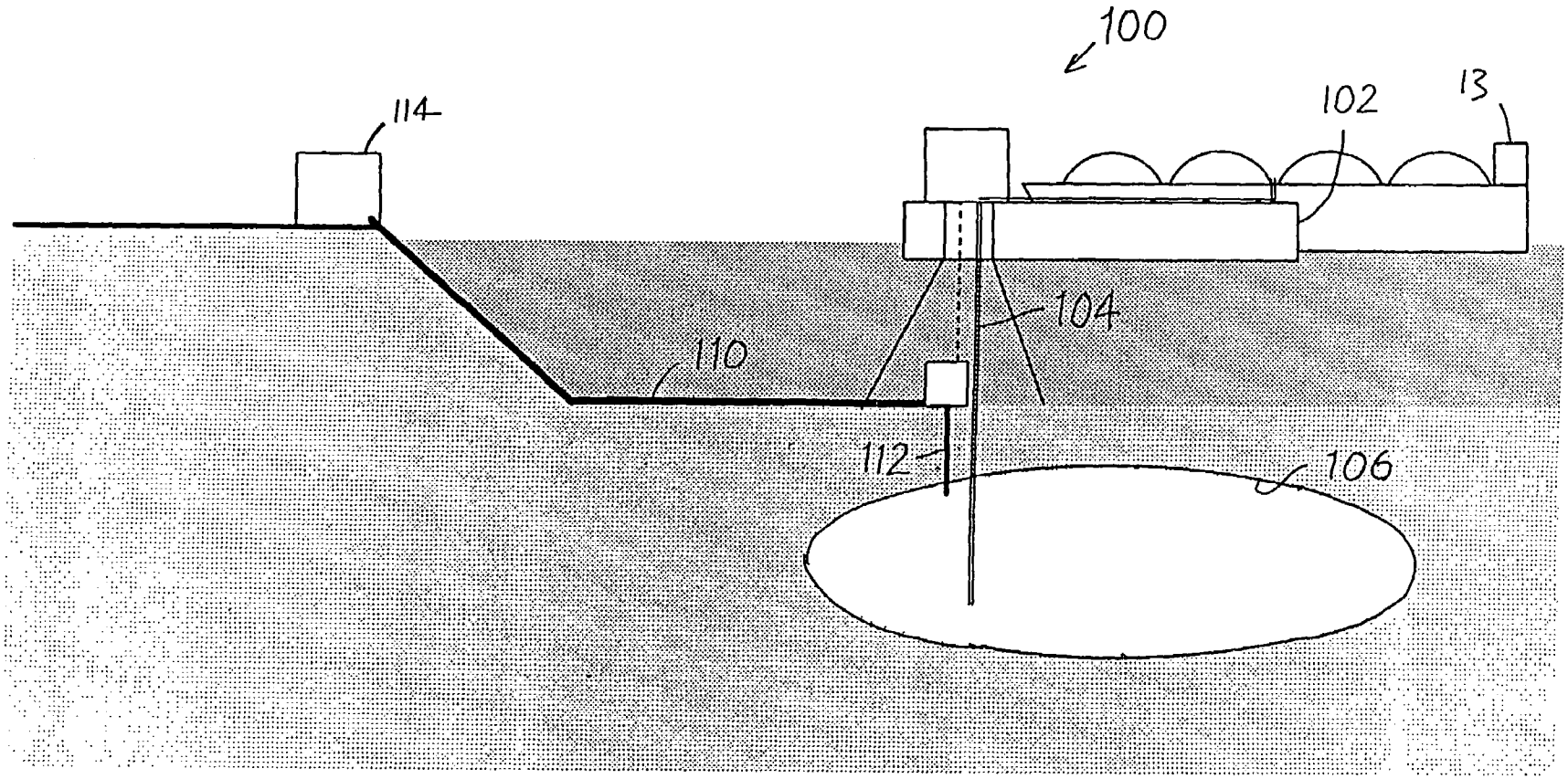
FIG. 3 is a partially sectional side view of an offshore gas offloading and transfer system of another embodiment of the invention.

FIG. 3 shows a system 100 in which the barge 102 injects LNG directly into the cavern through a cryogenic pipeline or flexible pipe 104. In the cavern 106 the LNG gradually changes into its gas phase. Gas is withdrawn through a separate pipe 112 leading from an upper portion of the cavern to a sea floor pipeline 110 that extends to an onshore station 114.

Figure 4:
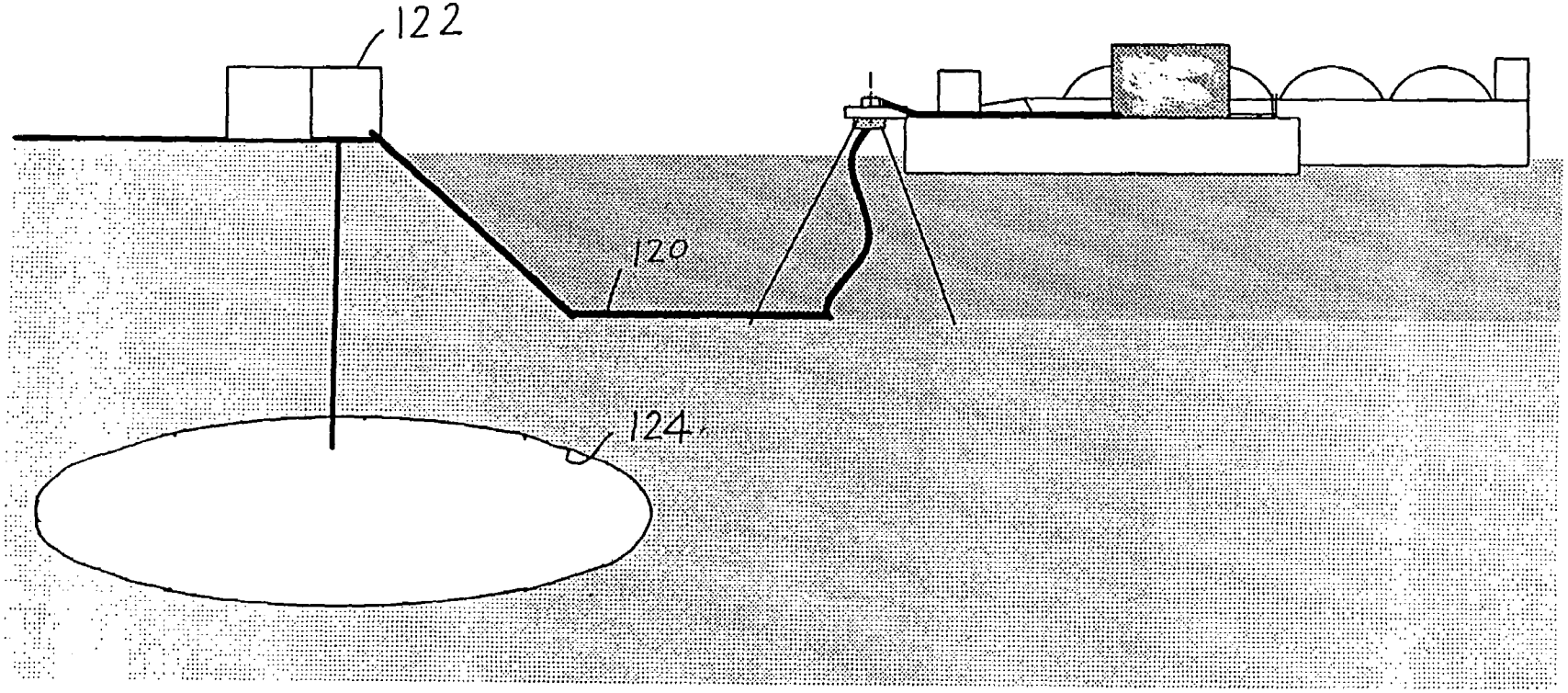
FIG. 4 is a partially sectional side view of an offshore gas offloading and transfer system of another embodiment of the invention.

In FIG. 4, all gas from the barge passes through a seafloor pipeline 120 to an onshore station 122 that injects it into a cavern 124 that is directly connected to the onshore station.

Figure 5:
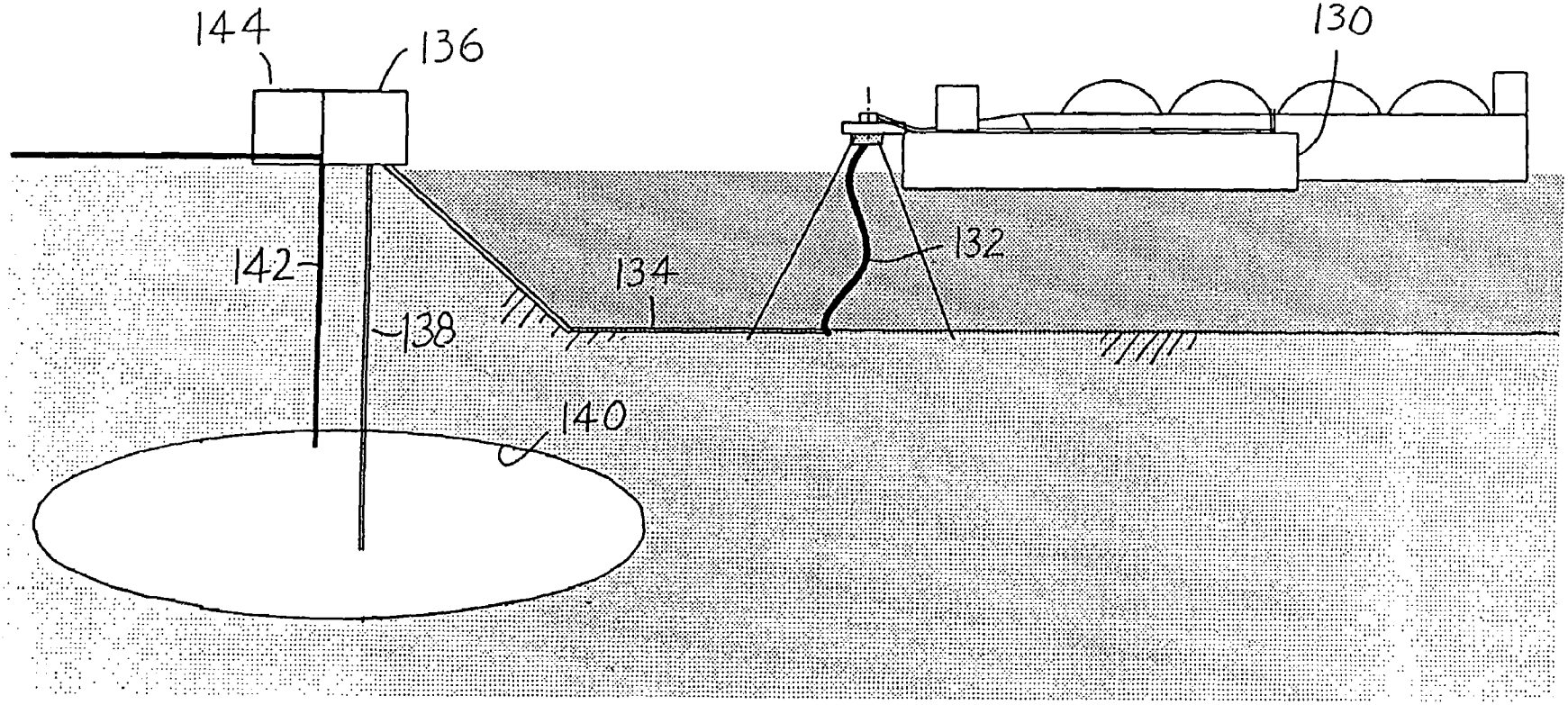
FIG. 5 is a partially sectional side view of an offshore gas offloading and transfer system of another embodiment of the invention.

In FIG. 5, cold LNG is pumped from the barge 130 through a cryogenic hose or pipeline riser 132, and passes through a cryogenic seafloor pipeline 134 directly into an onshore injector and regas unit 136 that connects through pipe 138 to the cavern 140. The injector 136 can inject LNG or can regas some or all of the LNG before injection, depending upon the expected rate of gas withdrawal and the amount already stored in the cavern. Gas is removed from the cavern through a separate pipe 142 leading to another onshore station 144.

FIG. 6 illustrate another offloading station 150 for offloading gaseous hydrocarbons from a tanker 152. The tanker 152 carries the hydrocarbons as LNG at −165° C. and atmospheric pressure. The station includes a direct-attachment floating structure 154. The direct-attachment floating structure includes a buoyancy-adjusting floating system 160 and a propulsion system 162 that allows the floating structure to lie low in the water, slowly propel itself until its under-tanker part 164 lies under the tanker, and then deballast itself (by emptying water from ballast tanks) until its parts 164, 166 engage the tanker. Such a structure has been previously used in offloading crude oil from tankers.

The particular floating structure 154 of FIG. 6 also includes a regas system 170 that warms the LNG so it becomes gaseous. The floating structure pumps the gaseous hydrocarbons through a riser 172 into a subsea cavern and/or through a pipeline to a shore station. By regasing LNG, applicant avoid the need to provide a cryogenic riser which may be very expensive.

FIG. 6 shows that a seafloor base 174 carries a fluid swivel 176. A hawser 180 that extends from a yoke 182 attached to the swivel, extends to the bow 184 of the tanker to moor the tanker so it weathervanes. The structure 154 weathervanes with the tanker.

Energy is required to power the propulsion and ballast systems, as well as the regas systems. The regas system will use pumped seawater, as to warm an intermediate liquid that warms LNG or even to directly warm the LNG to produce hydrocarbons in a gaseous state. The hydrocarbons are pumped into a cavern 191 (FIG. 7) and/or a sea floor gas pipeline 190 that extends to an onshore gas facility 192. Where the floating structure lies near shore (e.g. not much more than fifty kilometers from shore), power can be obtained from a power line 194 shown in FIG. 7. The power line preferably extends parallel to the pipeline. The shore end 196 of the power line can be connected to an on shore electric power facility such as a utility electric line 200, or to a special shore based power station. The floating structure shown in FIG. 6 as well as FIGS. 1–5, may consume on the order of magnitude of 60 megawatts of electricity when unloading a tanker. A power line to shore is most practical when the seafloor base lies within about fifty kilometers (less than 70 km) of shore so there are only moderate power losses along the power line. The power line preferably lies partially on the sea floor. In most cases the floating structure lies at least 50 meters from shore in its greatest excursion, and the seafloor platform lies at least 50 meters from shore (high tide).

It is also possible to provide a small power plant, indicated at 200 in FIG. 7, which uses a portion of the warmed gas as fuel to continually produce electric power. The power is used perhaps one day in five or seven primarily to pump sea water in the heat exchanger and to pressurize gas. During the other 4 days out of 5 or 6 days out of 7, the power is sent to shore along the power line 194.

Figure 8:
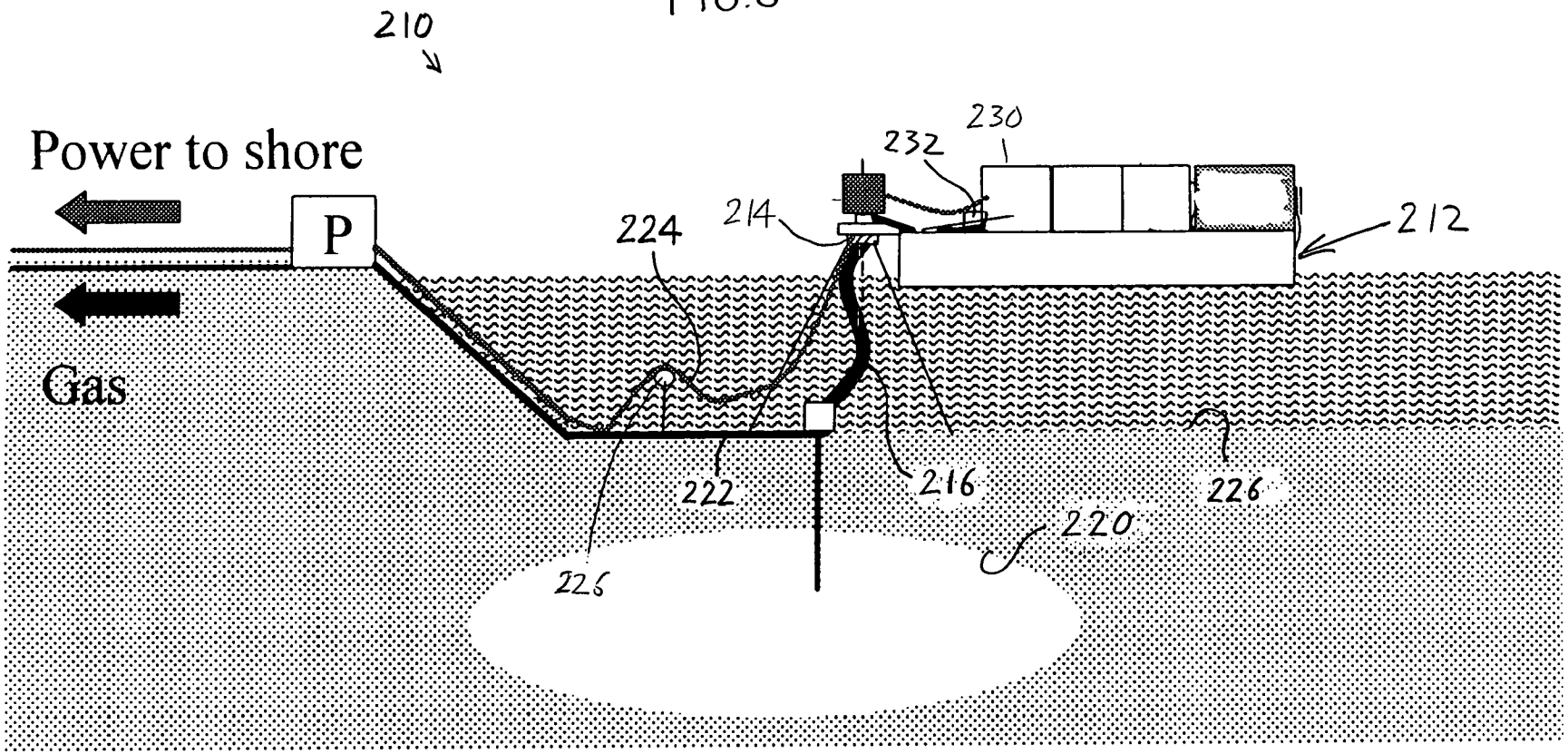
FIG. 8 is a sectional side view of an offshore gas offloading and transfer system of another embodiment of the invention.

FIG. 8 illustrates a system 210 which includes a floating structure 212 that is moored through its turret 214 to the sea floor. A riser (one or more risers) 216 carries gas to a seafloor reservoir 220 and to a pipeline 222 that extends along the sea floor to shore. An electric power line 224 that extends primarily along the sea floor, extends from the turret and over a buoy 226 and along the sea floor 226 to a facility on shore. The floating structure carries a gas-powered generator 230 that generates electricity for regasing (heating) LNG from a tanker (not shown) as by pumping sea water through a heat exchanger, and for pressurizing the gas. When not regasing or pumping, a switch arrangement 232 diverts the generated electric power through line 224 to an onshore facility, as to add to electricity generated by a local electric utility. Electricity can instead be transferred from a local utility to the power line to power equipment.

In environments that are subject to occasional harsh weather conditions such as a heavy storm or hurricane, the riser can be constructed to be disconnected from the floating structure, and laid down on the sea floor or floated in a submerged position. The floating structure can be disconnected from the riser and from its mooring system, and can be towed away, to be later reinstalled.

Thus, the invention provides a gas offloading and transfer system for transferring gas from a tanker (wherein the gas is stored in a liquid-like state such as LNG) to an undersea or underground cavern and/or to the shore. The system can be constructed at moderate cost even when it must lie in a sea of considerable depth. The system includes a floating structure such as a barge, which is moored, as by catenary chains, to the seafloor. In most cases the floating structure is moored so it weathervanes, to change direction so as to always face the sea in the direction of least resistance. A tanker that brings the gas to the barge is moored to weathervane with the floating structure, so the tanker and floating structure can remain attached to one another during offloading in the open sea. A weathervaning tanker could not be easily moored to a fixed platform in an open sea. In one system, the floating structure is a weathervaning barge. In another system, the floating structure is a direct attachment floating structure that, by itself, may not have a bow end that turns to always faces upwind, but which attaches to a tanker that is moored and thereby weathervanes with the tanker. An electric current-carrying power cable can extend between the floating structure and a shore-based electric power structure, to deliver electric power to the floating structure to energize pumps and other equipment, or to carry electricity from a power plant on the floating structure to shore when not used at the floating structure.

What is claimed is:

1. An offshore gas unloading system that lies in a sea having a sea surface and a sea floor, wherein a tanker unloads liquified cold hydrocarbons that are gaseous at room temperature, comprising:

a floating structure that lies at the sea surface and that is moored so it weathervanes;

a regas unit on said floating structure, that heats at least some of the cold hydrocarbons that were received from the tanker;

a sea floor platform that lies at the sea floor;

a riser that extends from said floating structure to said sea floor platform to carry hydrocarbons from one to the other;

said floating structure being connected to said tanker to form a combination of said floating structure and said tanker that weathervane together;

at least one mooring line that extends from the sea floor to said combination to moor the combination and allow it to weathervane;

an underground cavern and a pipe that is coupled to said cavern and to said riser, to thereby store at least some of the gas in the cavern.

2. The system described in claim 1 including:

an onshore gas distribution station;

a seafloor pipeline that is coupled to said cavern and that extends primarily along the sea floor from said cavern to said onshore station to carry said gas from said cavern to said onshore station.

3. The system described in claim 1 including:

an onshore gas distribution station;

a second riser extending from said floating structure to sea floor;

a sea floor pipeline that extends primarily along the sea floor from a lower end of said second riser to said onshore station, whereby to enable the passage of gas into said cavern or directly to said onshore station without passing through said cavern.

4. The system described in claim 1 including:

an onshore gas distribution station;

said riser comprises a cryogenic hose, and including a connection that carries some of the cold hydrocarbons received by the floating structure, directly to the cavern without passing through said regas unit so liquid cold hydrocarbons pass down through said cryogenic hose;

said cavern has upper and lower portions, and including a sea floor gas pipeline that has a proximal end coupled to said cavern upper portion to receive gas therefrom, said pipeline extending to said onshore station.

5. The system described in claim 1 wherein:

said regas unit is electrically energized; and including an electric generator apparatus mounted on said floating structure, which is fueled by gas from said regas unit and that generates electricity to energize said regas unit.

6. The system described in claim 5 including:

an onshore electric power distributing facility;

an electric current-carrying power line extending from said electric generator apparatus to the sea floor and along the sea floor to said onshore facility for carrying power to said onshore facility when such power is not required at the floating structure.

7. The system described in claim 1 wherein:

said regas unit is electrically energized; and including an onshore power distributing facility;

an electric current-carrying power line that extends along the sea floor from said onshore facility to a location under said floating structure and up through the sea to said floating structure to carry electric power to said regas unit.

8. An offshore gas unloading system that lies in a sea that has a sea floor and a sea surface, and that lies within about fifty kilometers of a shore, for unloading cold hydrocarbons from a tanker, comprising:

a floating structure that lies at the sea surface and that has a fluid coupling for receiving said liquid cold hydrocarbons from said tanker;

a cavern that stores gas;

a sea floor platform and at least one pipe that extends from said sea floor platform to said storage facility;

at least one riser that extends from said floating structure to said sea floor platform and that is coupled to said pipe to carry hydrocarbons between said sea-surface structure and said cavern;

said floating structure carrying an electrically powered equipment including a regas unit;

an electric power facility that lies on the shore;

a current carrying power line that extends between said sea-surface structure and said electric power facility on the shore, to carry electricity between them.

9. The system described in claim 8 including:

an electricity generator mounted on said floating structure that supplies electricity to said equipment, and an electric switch arrangement that delivers electricity from said generator to said power line when much of the electricity is not required for said equipment.

10. The system described in claim 8 wherein:

said electric power facility that lies on the shore is constructed to deliver electrical power to said power line, to provide electrical power to energize said equipment.

11. The system described in claim 8 wherein:

said storage facility comprises an underground cavern that is connected to an end of said pipe that is opposite said riser; and including a gas-powered electricity generator on said floating structure;

a valve arrangement that is operable to pass said gas from said regas unit through said riser and pipe to said cavern, and to pass gas from said cavern through said pipe and said riser to said electricity generator, whereby the cavern stores gas to power the electricity generator.

12. A gas offloading system that lies off shore in a sea, for receiving cold liquified gaseous hydrocarbons from a tanker, comprising:

an offshore structure that lies at the sea surface and that has a coupling for receiving said liquified hydrocarbons from the tanker;

a regas unit mounted on said offshore structure to heat said cold hydrocarbons to produce gas;

an electric power-generating facility on said offshore structure that is powered by said gas and that produces electricity;

an onshore power facility that distributes electric power;

a current carrying power line that extends between said electric power-generating facility and said onshore power facility to carry electricity from said power-generating facility to said onshore power facility.

13. The system described in claim 12 wherein:

said regas unit consumes electric power in the heating of said cold gas, and including a switch arrangement that directs electricity from said electric power-generating facility to said regas unit to heat cold gas when such cold gas is received from a tanker, said switch arrangement being switchable to direct electricity from said electric power-generating facility to said power line when the regas unit is not operated to heat cold gas.

14. A method for operating an offshore facility that lies off shore, and that unloads cold hydrocarbons from a tanker, for delivery of the hydrocarbons after warming, to a shore station on the shore, comprising:

offloading cold hydrocarbons from the tanker to a floating structure that has a regas unit, and passing said cold hydrocarbons through said regas unit to produce warmed gaseous hydrocarbons;

flowing at least some of said warmed gaseous hydrocarbons down along a riser to an underground cavern and storing said warmed hydrocarbons in the cavern;

flowing gaseous hydrocarbons through a sea floor pipeline from said cavern to an onshore gas distribution station.

15. The method described in claim 14 including:

flowing a second portion of said warmed gas down along a riser directly to said sea floor pipeline so said second portion of the gas flows to the onshore station without having first passed into said cavern.

16. The method described in claim 14 including:

energizing said regas unit with electricity, including using some of said warmed gaseous hydrocarbons to fuel an electrical generator apparatus on said floating structure to generate electric power to energize said regas unit;

delivering electricity from said electrical generator apparatus along a sea floor electric power line to an onshore facility when excess electric power is available from said electric generator apparatus.

17. The method described in claim 14 including:

energizing said regas unit with electricity;

delivering electricity from an onshore facility along a sea floor electric power line to said floating structure to energize said regas unit with electric power from the onshore facility.

18. A method for operating an offshore facility that lies off shore, and that unloads liquid cold hydrocarbons from a tanker, for delivery of the hydrocarbons as gas after warming, to a shore station on the shore, comprising:

offloading cold liquid hydrocarbons from the tanker to a floating structure that has a regas unit, energizing said regas unit and passing said cold hydrocarbons through said regas unit to produce warmed gaseous hydrocarbons;

flowing at least some of said warmed gaseous hydrocarbons down along a riser, and flowing warmed gaseous hydrocarbons through a sea floor pipeline to an onshore gas distribution station;

said step of energizing said regas unit includes using some of said warmed gaseous hydrocarbons as fuel to energize an electricity generating apparatus on said floating structure that generates electricity, and supplying at least some of said electricity from said electricity generating apparatus to said regas unit to energize it;

passing some of said electricity from said electric generating apparatus through an electric power line that extends along the sea floor, to an onshore power distribution station.

19. A method for operating an offshore facility that lies off shore, and that unloads cold liquid hydrocarbons from a tanker, for delivery of the hydrocarbons after warming, to a shore station on the shore, comprising:

offloading cold hydrocarbons from the tanker to a floating structure that has a regas unit, energizing said regas unit and passing said cold hydrocarbons through said regas unit to produce warmed gaseous hydrocarbons;

flowing at least some of said warmed gaseous hydrocarbons down along a riser, and flowing warmed gaseous hydrocarbons through a sea floor pipeline to an onshore gas distribution station;

said step of energizing said regas unit includes carrying electric power from an onshore facility and along an electric power line that extends along the sea floor and up to said floating structure to said regas unit to energize said regas unit with electric power from the shore.

* * * * *